United States Patent [19]

Holmes

[11] 4,164,858

[45] Aug. 21, 1979

[54] ROLLING MILL WITH ROLL BENDING UNIT

[75] Inventor: Gordon D. Holmes, Worksop, England

[73] Assignee: Davy-Loewy Limited, Yorkshire, England

[21] Appl. No.: 918,543

[22] Filed: Jun. 23, 1978

[30] Foreign Application Priority Data

Jun. 24, 1977 [GB] United Kingdom ..... 26633/77

[51] Int. Cl.[2] ..... B21B 29/00

[52] U.S. Cl. ..... 72/237; 72/245

[58] Field of Search ..... 72/245, 237, 241, 246

[56] References Cited

U.S. PATENT DOCUMENTS

| | | | |
|---|---|---|---|
| 3,373,588 | 3/1968 | Stone | 72/237 |
| 3,621,695 | 11/1971 | Eibe et al. | 72/245 X |
| 3,645,122 | 2/1972 | Harlow | 72/237 |

*Primary Examiner*—Milton S. Mehr

*Attorney, Agent, or Firm*—Daniel Patch; Suzanne Kikel

[57] ABSTRACT

A rolling mill includes an assembly which can be withdrawn from the two housings. The assembly has two rolls with each roll having a pair of bearing chocks on the roll necks and a pair of further chocks positioned outwardly of the bearing chocks one on each of a pair of extensions of the roll necks. Fluid operable means positioned between the corresponding further chocks permit bending forces in one direction to be applied to the rolls and bending forces in the opposite direction are applied to the rolls by fluid operable means acting between the further chocks of one roll and a reaction member fixed relative to the further chocks of the other roll.

6 Claims, 2 Drawing Figures

ROLLING MILL WITH ROLL BENDING UNIT

Figure 1:
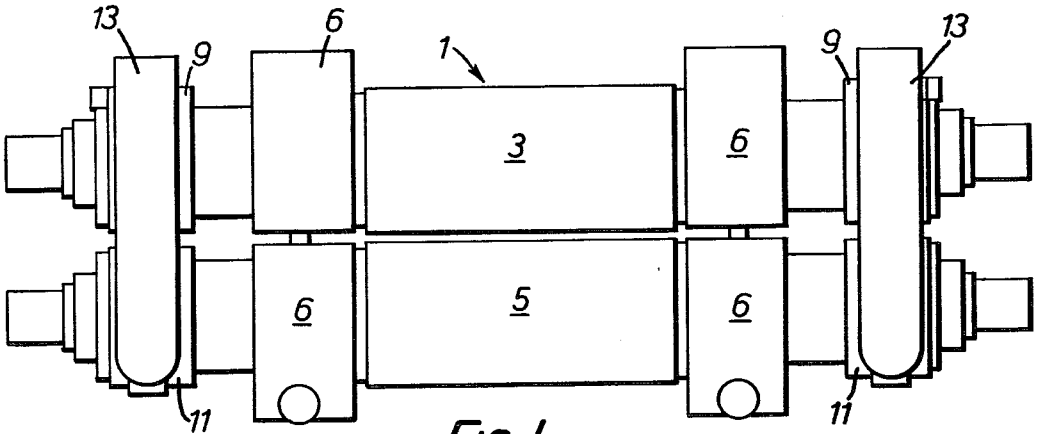

This invention relates to rolling mills which have provision for bending the rolls during operation of the mill and to an assembly for use in such a mill, the assembly comprising the rolls and the means for bending them.

It is now well known to provide roll bending facilities on a pair of rolls of a rolling mill in order to produce a rolled product having improved uniformity in gauge and flatness. The provision for roll bending may be provided on a pair of work rolls of a rolling mill or on a pair of back-up rolls. Various forms of roll bending have been put forward and some schemes need a complicated housing design and others need the provision of heavy beams to take the reaction of the roll bending forces and these beams necessitate the mill housings being enlarged. Furthermore in the known schemes complications can occur at roll changing in that, in many of the schemes, the roll changing apparatus has to be dismantled before the rolls can be withdrawn from the mill housings.

It is an object of the present invention to provide an assembly for use in a rolling mill in which at least some of the above-mentioned difficulties present in the known schemes are overcome.

It is a further object of the present invention to provide a rolling mill which includes such an assembly.

According to a first aspect of the present invention, an assembly for use in a rolling mill comprises first and second rolls each having a roll barrel, a roll neck at each end of the barrel, a first bearing chock on each neck and a further bearing chock on an extended portion of each neck positioned outwardly of the first bearing chock, the rolls being arranged one above the other with their longitudinal axes parallel, each of the two further chocks on the first roll having a reaction member positioned on the side of the corresponding further chock of the second roll which is remote from the first roll, fluid operable means positioned between the corresponding further chocks of the two rolls and arranged so that on being actuated the separation of the further chocks is increased and fluid operable means positioned between the reaction member and the further chocks of the second roll and arranged so that on being actuated the separation of the further chocks is reduced.

According to a second aspect of the invention, a rolling mill has a pair of spaced apart housings each defining a window, a pair of rolls arranged one above the other with their longitudinal axes parallel and each supported in two bearing chocks located one in each of said windows, and each roll having an extension at each end outwardly of the bearing chocks and a further bearing chock on each extension, the further bearing chocks at the corresponding ends of the rolls having fluid operable means located therebetween and arranged such that on being actuated the means urge the further chocks apart to apply roll bending forces of one sense to the rolls, each of the two further bearing chocks on one of the rolls having a reaction member fixed relative thereto and positioned on the opposite side of the corresponding further bearing chock of the other roll, and fluid operable means located between the further bearing chocks of said other roll and the reaction members and arranged such that on being actuated the means urge the further bearing chocks towards each other to apply roll bending forces of the opposite sense to the rolls.

In one embodiment of the invention, each reaction member is part of a closed loop surrounding the two further chock assemblies at each of the corresponding ends of the rolls. Alternatively, however, the reaction member may take the form of a U-shaped yoke having one of the further bearing chocks mounted across its open end with the other further bearing chock movably mounted within the yoke, one of the fluid operable means acting between the movable chock and the yoke in the direction towards the other bearing chock.

With such an arrangement, the further bearing chocks at each of the corresponding ends of the rolls can be forced apart by applying fluid to the operable means located between the bearing chocks thereby providing roll bending forces on the rolls or alternatively by applying fluid to the other operable means, one of the bearing chocks is urged towards the other to apply roll bending forces of the opposite sense to the rolls and the reaction is contained within the reaction member. Consequently, no bending beams are required in the housings of the mill and no increase in size of the housings is necessary. In fact, no significant modification to the housing windows of a mill without this roll bending facility is necessary in order to provide the roll bending facility on the mill. During roll changing, the roll assembly can be withdrawn in situ through the housing windows of the mill stand by conventional roll change methods.

Figure 2:
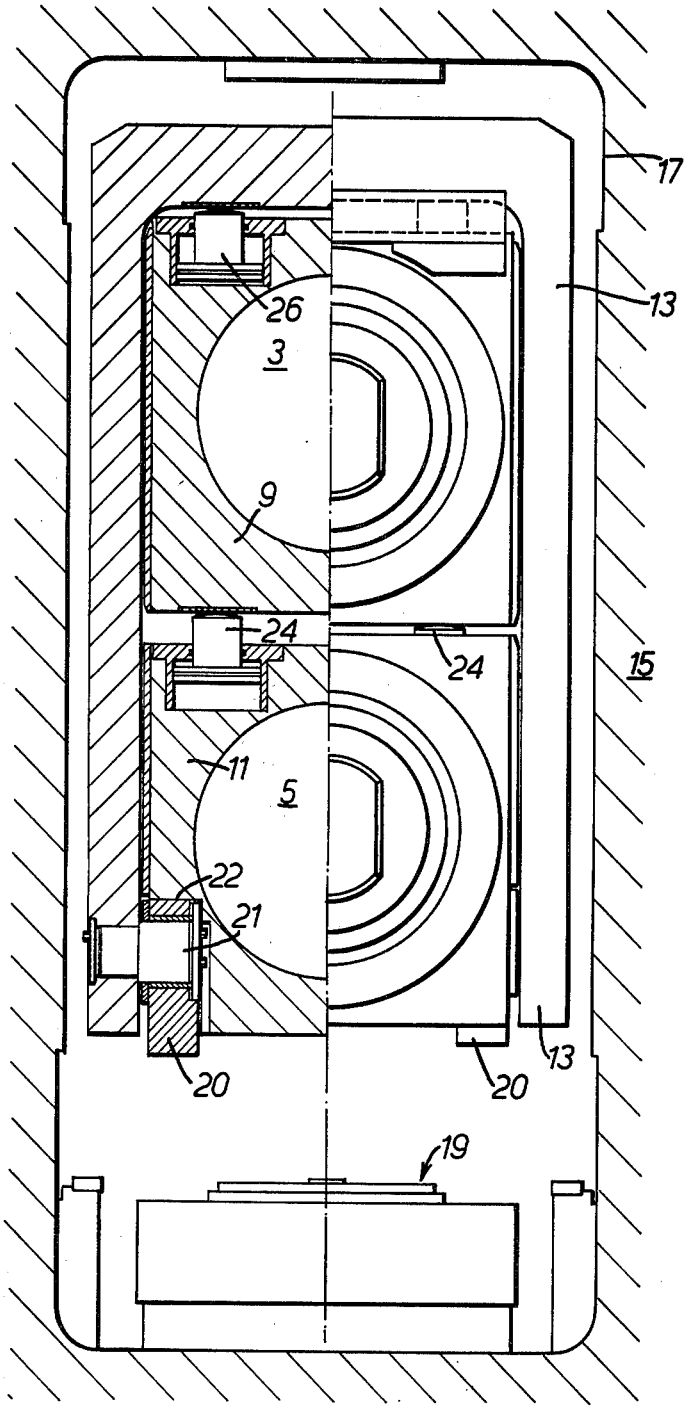

In order that the invention may be more readily understood it will now be described, by way of example only, with reference to the accompanying drawings, in which:

FIG. 1 is a side elevation of a roll assembly suitable for use in a rolling mill, and FIG. 2 is a section through part of a rolling mill showing the roll assembly installed in the mill.

Referring to FIG. 1, an assembly 1 suitable for installation in a rolling mill comprises a pair of rolls 3, 5 arranged one above the other. Each roll has a pair of bearing chocks 6 mounted on the necks of the rolls. Each neck has an extension portion and on this extension portion there is a further bearing chock positioned outwardly of the bearing chocks 6. The further bearing chocks for the roll 3 are indicated by reference numeral 9 and the further bearing chocks for the roll 5 are indicated by reference numeral 11. Each of the bearing chocks 11 has a yoke 13 associated with it. The yoke is fixed relative to the chock 11 and is of U-shape and passes around the further bearing chock 9 at the corresponding end of the roll 3. As will be described later with reference to FIG. 2, the yokes 13 are pivotally secured to the chocks 11 so that they can be pivoted outwardly with respect to the chocks 11 to enable the roll 3 with its bearing chocks to be lifted away from the lower roll 5.

Referring now to FIG. 2, the housing 15 of a rolling mill defines a window 17. Within the window there are mounted the bearing chocks 6 of the rolls 3, 5. The bearing chocks are displaceable vertically in the window of each housing by means of a hydraulic piston and cylinder assembly 19 located in the bottom of each window.

The yoke 13 can be seen to be of U-shaped form and a pair of blocks 20 are positioned inside the open ends of the yoke and each one is pivotally secured to the adjacent limb of the yoke by a pivot pin 21. The bearing chock assembly 11 has a pair of cut away portions 22 positioned on opposite sides which receive the blocks 20 in order to mount the chock 11 across the open end of the yoke. The further bearing chock 9 is positioned within the yoke above chock 11 and has limited vertical movement with respect to the yoke.

Mounted in the upper surface of each of the further chocks 11 are a pair of fluid operable piston and cylinder devices 24 which bear against the adjacent under surface of the further chock 9. In a similar manner a pair of fluid operable piston and cylinders 26 are located in the upper surface of the chock 9 and the plungers of the piston and cylinder devices engage against the adjacent end of the yoke 13 which serves as a reaction member.

If the fluid operable devices 26 are not supplied with fluid under pressure but fluid under pressure is supplied to the devices 24, then the chock 9 is urged away from the chock 11. Forces are thus applied to the two rolls 3, 5 through the bearing chocks 9 and 11 and these forces bend the two rolls. The ends of the rolls are forces apart bringing the barrels of the two rolls closer together. Alternatively, the piston and cylinder assemblies 24 are de-actuated and fluid under pressure in introduced into the devices 26, then the chocks 9 are urged towards the chocks 11. This again applies bending forces to the two rolls, but in this case the ends of the rolls are urged towards each other and the roll barrels are urged away from each other.

In the arrangement shown, the open end of the yoke 13 is closed by the bottom bearing chock 11. In an alternative arrangement the yoke could be closed by a member which is separate from the chock 11, in which case both of the bearing chocks would be contained within a closed loop. In a further arrangement, the chocks 11 could be bolted to the side limbs of the yokes.

In the arrangement shown, the rolls are the work rolls of a two-high mill, but the invention is applicable also to the back-up rolls of a four-high rolling mill. During roll changing, the two rolls with their bearing chock assemblies 6, 11 and 9 and the yokes 13 are withdrawn from the mill as an assembly. It can be seen from FIG. 2 that the dimensions of the yokes 13 and the chocks 11 are such that they can readily pass through the windows defined by the mill housings. In the arrangement shown, the yokes 13 can be pivoted about the pins 21 after the assembly has been removed from the mill so that the top roll can be lifted off the bottom roll and the bottom roll can then be lifted off the blocks 20.

What I claim as my invention and desire to secure by Letters Patent is:

1. An assembly for use in a rolling mill, said assembly comprising first and second rolls each having a roll barrel, a roll neck at each end having a first bearing chock inboard of said each end and a further bearing chock on an extended portion of each neck positioned outwardly of the first bearing chock, the rolls being arranged one above the other with their longitudinal axes parallel, each of the two further chocks on the first roll having a reaction member positioned on the side of the corresponding further chock of the second roll which is remote from the first roll, fluid operable means positioned between the corresponding further chocks of the two rolls and arranged so that on being actuated the separation of the further chocks is increased and fluid operable means positioned between the reaction member and the further chocks of the second roll and arranged so that on being actuated the separation of the further chocks is reduced.

2. An assembly as claimed in claim 1, in which there are two reaction members, one for each end of the roll, and each reaction member forms part of a U-shaped yoke, the open end of which is fixed relative to the further chock of the first roll, the further chock of the second roll being located within the yoke.

3. An assembly as claimed in claim 2, in which the yoke is pivotally mounted with respect to the further chock of the first roll such that the yoke can be pivoted with respect to the further chock to a position in which the further chock of the second roll is no longer located within the yoke.

4. An assembly as claimed in claim 1, in which there are two reaction members, one for each end of the roll and each reaction member forms part of a closed loop which surrounds the further chocks of the two rolls.

5. An assembly as claim 1, in which the fluid operable means positioned between the corresponding further chocks comprises at least one piston-cylinder device with the cylinder of the device located in the further chock of the first roll and the piston engageable with the further chock of the second roll and the fluid operable means positioned between the reaction member and the further chocks of the second roll comprises at least one piston-cylinder device with the cylinder of the device located in the further chock of the second roll and the piston engageable with the reaction member.

6. A rolling mill having a pair of spaced apart housings each defining a window, a pair of rolls arranged one above the other with their longitudinal axes parallel and each supported in two bearing chocks located one in each of said windows, and each roll having an extension at each end outwardly of the bearing chocks and a further bearing chock on each extension, the further bearing chocks at the corresponding ends of the rolls having fluid operable means located therebetween and arranged such that on being actuated the means urge the further chocks apart to apply roll bending forces on one sense to the rolls, each of the two further bearing chocks on one of the rolls having a reaction member fixed relative thereto and positioned on the opposite side of the corresponding further bearing chock of the other roll, and fluid operable means located between the further bearing chocks of said other roll and the reaction members and arranged such that on being actuated the means urge the further bearing chocks towards each other to apply roll bending forces of the opposite sense to the rolls.

* * * * *

UNITED STATES PATENT AND TRADEMARK OFFICE

CERTIFICATE OF CORRECTION

PATENT NO. : 4,164,858

DATED : August 21, 1979

INVENTOR(S) : Gordon David Holmes

It is certified that error appears in the above–identified patent and that said Letters Patent are hereby corrected as shown below:

Col. 3, line 20, "forces" should read -- forced --

Col. 3, line 23, "in" should read -- is --

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*